US007285241B2

(12) United States Patent
Puide

(10) Patent No.: US 7,285,241 B2
(45) Date of Patent: Oct. 23, 2007

(54) METHOD OF MANUFACTURING HARD MATERIAL COMPONENTS

(75) Inventor: Mattias Puide, Västerås (SE)

(73) Assignee: Seco Tools AB, Fagersta (SE)

( * ) Notice: Subject to any disclaimer, the term of this patent is extended or adjusted under 35 U.S.C. 154(b) by 387 days.

(21) Appl. No.: 10/924,856

(22) Filed: Aug. 25, 2004

(65) Prior Publication Data

US 2005/0200054 A1 Sep. 15, 2005

(30) Foreign Application Priority Data

Aug. 27, 2003 (SE) ..... 0302314

(51) Int. Cl.
*C04B 33/32* (2006.01)
*B23B 27/00* (2006.01)

(52) U.S. Cl. ..... 264/625; 264/656; 264/604; 264/683

(58) Field of Classification Search ..... 264/125, 264/681, 645, 683, 604, 656
See application file for complete search history.

(56) References Cited

U.S. PATENT DOCUMENTS 4,478,888 A * 10/1984 Benjamin et al. ..... 427/220
4,684,405 A * 8/1987 Kolaska et al. ..... 75/240
4,902,471 A * 2/1990 Penkunas et al. ..... 419/33
4,963,183 A * 10/1990 Hong ..... 75/241
5,194,203 A * 3/1993 Kankawa et al. ..... 264/125
5,288,676 A * 2/1994 Shimada et al. ..... 501/93
5,419,857 A * 5/1995 Van den Sype ..... 264/40.1
5,531,958 A 7/1996 Krueger
5,580,666 A * 12/1996 Dubensky et al. ..... 428/552
5,627,258 A * 5/1997 Takayama et al. ..... 528/338
5,746,960 A 5/1998 Yoshikawa et al.
5,809,848 A * 9/1998 Viswanadham et al. ..... 76/112
6,051,184 A * 4/2000 Kankawa ..... 419/36
6,368,377 B1 * 4/2002 Bryant et al. ..... 75/240
2005/0133972 A1 6/2005 Bruhn et al.

FOREIGN PATENT DOCUMENTS

EP 0501602 A 9/1992
WO WO 98/18973 5/1998

* cited by examiner

*Primary Examiner*—Carlos Lopez
(74) *Attorney, Agent, or Firm*—Drinker Biddle & Reath LLP

(57) ABSTRACT

The present invention relates to a method of making a sintered body comprising one or more hard constituents in a binder phase by injection molding or extrusion. According to the invention, the granulating agent during drying is an ethylene oxide polymer and the binder system is not miscible with that compound. The extraction step is performed in an alcohol based solvent at a temperature of 50-78° C., preferably 60-78° C.

18 Claims, 1 Drawing Sheet

METHOD OF MANUFACTURING HARD MATERIAL COMPONENTS

BACKGROUND OF THE INVENTION

The present invention relates to a method for the production of hard metal tools or components using the powder injection molding or extrusion method.

Hard metals are composites consisting of small (μm-scale) grains of at least one hard phase in a binder phase. In the case of tungsten carbide based hard metals, these materials always contain the hard phase tungsten carbide (WC). In addition, other metal carbides with the general composition (Ti,Nb,Ta,W)C may also be included, as well as metal carbonitrides, e.g., Ti(C,N). The binder phase composition may be Co, Ni, and Fe, or combinations thereof. Co is preferred.

Titanium carbonitride based hard metals do not contain the tungsten carbide phase, i.e. WC.

Industrial production of hard metals often includes blending of given proportions of powders of raw materials and additives in the wet state using a milling liquid. This liquid is often an alcohol, e.g., ethanol, or water, or a mixture thereof. The mixture is then milled into a homogeneous slurry. The wet milling operation is made with the purpose of deagglomeration and mixing the raw materials intimately. Individual raw material grains are also disintegrated to some extent. The obtained slurry is then dried and granulated, e.g. by means of a spray drier. The granulate thus obtained may then be used in uniaxial pressing of green bodies or for extrusion or injection molding.

Injection molding is common in the plastics industry, where material containing thermoplastics or thermosetting polymers are heated and forced into a mold with the desired shape. The method is often referred to as Powder Injection Molding (PIM) when used in powder technology. It is preferably used for parts with complex geometry.

In powder injection molding, four consecutive steps are applied:

1. Mixing of the granulated powder with a binder system. The binder system acts as a vehicle for the powder and constitutes 25-55 volume % of the resulting material, often referred to as the feedstock. The exact concentration is dependent on the desired process properties during molding. The mixing is made with the binder system in molten state. The resulting feedstock is obtained as pellets of approximate size 4×4 mm.

2. Injection molding is performed using the mixed feedstock. The material is heated to 100-240° C. and then forced into a cavity with the desired shape. The thus obtained part is cooled and then removed from the cavity.

3. Removing the binder from the obtained part. The removal can be obtained by wet extraction of the parts and/or by heating in a furnace with a suitable atmosphere. This step is often referred to as the debinding step.

4. Sintering of the parts. Common sintering procedures for hard metals are applied.

Extrusion of the feedstock comprises steps 1,3 and 4 above. Instead of forcing the feedstock into a cavity of the desired shape, the feedstock is continuously forced through a die with the desired cross section.

EP-A-963454 (WO 98/18973)discloses a method of making a sintered body comprising one or more hard constituents in a binder phase by injection molding technique comprising wet milling of a powder mixture containing powders forming the hard constituents and binder phase, drying said milled powder mixture, mixing said powder mixture with organic binder, waxes and surfactant into a feedstock, molding the feedstock into bodies of desired shape in a conventional plastic injection molding machine, debinding said body and sintering. If the surfactant is introduced already during the milling operation, the level of porosity in the body is significantly reduced.

OBJECTS AND SUMMARY OF THE INVENTION

It is therefore an object of the present invention to provide a method of making a sintered body comprising one or more hard constituents in a binder phase by injection molding or extrusion technique comprising mixing by wet milling of powders forming the hard constituents and binder phase with a granulating agent to form a slurry, said granulating agent being an ethylene oxide polymer;

drying the slurry formed into a powder;

mixing the powder with a binder system into a feedstock binder system being not miscible with said ethylene oxide polymer;

molding said feedstock into a body of desired shape in an injection molding machine or extruder;

debinding of the obtained body in two steps comprising a first step of extraction and by a second step of heating said extraction step being conducted in an alcohol based solvent at a temperature of about 50-78° C., and sintering.

DETAILED DESCRIPTION OF THE PREFERRED EMBODIMENTS OF THE INVENTION

Figure 1:
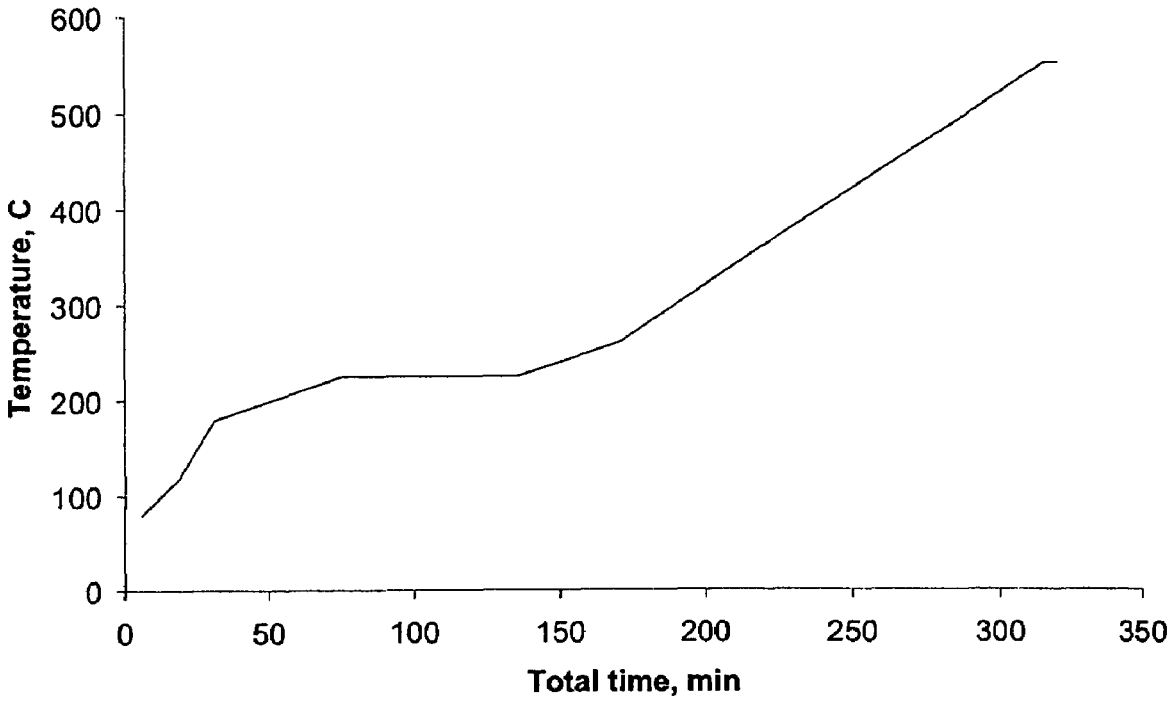
FIG. 1 is a time/temperature profile for the debinding of a part of about 17 g.

It has now surprisingly been found that by using an ethylene oxide polymer, such as (poly(oxy-1,2-ethanediyl), .alpha.-hydro-.omega.-hydroxy-) as a granule forming agent together with a binder system, of poly(ethylene-co-vinylacetate) and (Polyethylene)-blend-(poly(oxy-1,2-eth-anediyl), .alpha.-hydro-.omega.-hydroxy-)-based wax or of polyethylene glycol and (Polyethylene)-blend-(Poly(oxy-1,2-ethanediyl), .alpha.-hydro-.omega.-hydroxy-)-based wax, parts can easily be injection molded, and rapidly debound partly by extraction at elevated temperature in ethanol followed by degradation and evaporation in hydrogen at elevated temperature.

The method according to the present invention comprises the following steps:

1) Wet milling of the raw materials in water, alcohol or a combination thereof, preferably 80 wt % ethanol, and 20 wt % water, together with the ethylene oxide polymer. The smaller the grain size of the WC, the more granulating agent is used. The amount of the granulating agent to raw material can vary according to the knowledge of the skilled artisan but is generally in the range of from about 0.5 to 5% by weight, preferably from about 1.5 to 2.5% by weight of the total of the raw material and granulating agent.

A preferred granulating agent is (poly(oxy-1,2-ethanediyl), .alpha.-hydro-.omega. -hydroxy- having a molecular weight of from 1000 to 10,000 g/mol. Similar acting polymers may also be used.

The wet milling of these materials results in a slurry of the raw materials in the water and/or alcohol.

2) Drying of the slurry formed during the above-mentioned wet milling process step. The drying can be performed at any suitable temperature and time, as would be understood by the skilled artisan depending upon, for example, the particular solution used to form the slurry.

3) Mixing the dried powder by kneading with a binder system which is not miscible with the granulating agent. For example, a mixture of 30-90 wt %, preferably 60-80 wt %, poly(ethylene-co-vinylacetate), balance (Polyethylene)-blend (Poly(oxy-1,2-ethanediyl), .alpha.-hydro-.omega.-hydroxy-)-based wax can be used.

An example of a (Polyethylene)-blend-(Poly(oxy-1,2-ethanediyl), .alpha.-hydro-.omega.-hydroxy-)—based wax is the commercially available. Such a product is available commercially from Clariant as Licomont EK 583. Similarly acting binder materials may also be used.

The mixing is preferably performed in a twin screw extruder, heated to 50-200° C., that forms pellets with a size of approximately 4×4 mm. The solids loading of the feedstock, γ, shall be $0.48<\gamma<0.54$, controlled by measuring the density by means of a helium pycnometer. The solids loading is then calculated using the following equation:

$$\gamma = \frac{\rho_f - \rho_b}{\rho_s - \rho_b}$$

where $\rho_s$ is the density of the material as sintered, $\rho_b$ is the density of the binder system and $\rho_f$ is the density of the feedstock, measured with the helium pycnometer.

4) Injection molding of the feedstock in a conventional injection molding machine. Alternatively, the feedstock is extruded in a single screw, twin screw or piston type extruder. The material is heated to 100-240° C., preferably 140-160° C., and then, in the case of injection molding, forced into a cavity with the desired shape. If extrusion is used, the material is forced through a die with the desired cross section. The part obtained in injection molding is cooled and then removed from the cavity. The extrudates are cut in pieces of desired length.

5) Debinding the obtained part. The debinding is performed in two steps.

5a) By extraction in an alcohol based solvent, the alcohol preferably being methyl, ethyl and/or propyl alcohol, most preferably ethyl alcohol, at a temperature of about 50-78° C., preferably 60-78° C., most preferably 60-70° C. The water content of the solvent should be below 30 wt %, preferably below 10 wt %, most preferably below 5 wt %.

5b) By heating in a furnace, preferably in flowing hydrogen atmosphere at atmospheric pressure up to 550° C. The debinding includes several ramps and soak times, depending of the size of the part. An example of the temperature profile for debinding of a part of about 17 g is shown in FIG. 1. It is within the purview of the skilled artisan to determine by experiments the conditions necessary to avoid the formation of cracks and other defects according to this specification.

6) Presintering of the part in the debinding furnace in vacuum at 900-1250° C., preferably at about 1200° C.

7) Sintering of the parts using conventional sintering technique, preferably in a sinter-HIP furnace.

The invention can be used for all compositions of cemented carbide and all WC grain sizes commonly used as well as for titanium carbonitride based materials.

In one embodiment, the grain size of the WC shall be 0.2-1.5 μm with conventional grain growth inhibitors. In another embodiment the grain size of the WC shall be 1.5-4 μm.

The invention is additionally illustrated in connection with the following Examples, which are to be considered as illustrative of the present invention. It should be understood, however, that the invention is not limited to the specific details of the Examples.

EXAMPLE 1

A WC-10 wt % Co submicron cemented carbide powder was made by wet milling 35.00 kg Co-powder (OMG extra fine), 1.743 kg $Cr_3C_2$ (H C Starck), 313.1 kg WC (H C Starck DS80), 0.257 kg carbon black and 8.75 kg (poly(oxy-1,2-ethanediyl), .alpha.-hydro-.omega.-hydroxy-) in 120 l milling liquid of ethanol and water (80:20 by weight) for 40 h. The resulting slurry was spray-dried to a granulated powder. The granules were of high quality and very little dust was generated during the spray drying process.

EXAMPLE 2 (COMPARATIVE)

A WC-10 wt % Co submicron cemented carbide powder was made by wet milling 35.00 kg Co-powder (OMG extra fine), 1.743 kg $Cr_3C_2$ (H C Starck), 313.1 kg WC (H C Starck DS80), 0.257 kg carbon black and 2.1 kg stearic acid in 120 l milling liquid consisting of ethanol and water (80:20 by weight) for 40 h. The resulting slurry was spray-dried to a granulated powder. The spray drying generated lots of dust and the quality and flowability of the powder was very poor.

EXAMPLE 3

The powder made in Example 1 was mixed by kneading 48.07 kg powder from Example 1 with 1.54 kg poly(ethylene-co-vinylacetate) (ExxonMobil Escorene Ultra UL 00728) and 0.39 kg Licomont EK583 (Clariant) in a twin screw extruder (Werner & Pfleiderer ZSK25). This resulted in a feedstock with a density of 8.08 g/cm$^3$, corresponding to $\gamma=0.525$.

EXAMPLE 4 (COMPARATIVE)

The powder made in Example 2 was mixed by kneading 47.29 kg powder from Example 2 with 1.35 kg poly(ethylene-co-vinylacetate) (ExxonMobil Escorene Ultra UL 00728) and 1.35 kg Licomont EK583 (Clariant) in a twin screw extruder (Werner & Pfleiderer ZSK25). This resulted in a feedstock with a density of 8.01 g/cm$^3$, corresponding to $\gamma=0.520$.

EXAMPLE 5

The feedstocks produced in the Examples 3-4 were injection molded in an injection molding machine (Arburg 320S) at 155° C. of the feedstock and 55° C. of the mold. The geometry of the mold was a Seco Tools Minimaster with three flutes, diameter 10 mm after sintering.

EXAMPLE 6

The feedstocks produced in the Examples 3-4 were extruded with a Werner & Pfleiderer zsk 25 at 140° C. of the feedstock and 90° C. of the die. The cross section of the die was a diameter 6 mm rod as sintered. The extrudates were cut in lengths of 85 mm.

EXAMPLE 7 (INVENTION)

The injection molded and extruded parts from Example 5 and 6 with feedstocks from Examples 3 and 4 were debound by extraction in a mixture of 95.5 wt % ethyl alcohol, 4 wt % methylethylketone and 0.5 wt % water at 60° C. for 6 hours and inspected for defects. The parts made from the feedstock of Example 4 were full of cracks on the surface while those made from the feedstock of Example 3 were free of defects.

EXAMPLE 8

The injection molded and extruded parts from Example 5 and 6 with feedstocks from Example 3 were debound by extraction in demineralised water at 60° C. for 3 and 8 hours and inspected for defects. The parts were free of defects.

EXAMPLE 9

The crack-free parts from Example 7 and the parts from example 8 were debound in a debinding furnace (Vacuum Industries Injectavac 50) in flowing hydrogen according to the temperature profile in FIG. 1. The gas flow rate was 50 standard $dm^3$ per minute up to 550° C. at which temperature the atmosphere was shifted to vacuum and the temperature was raised to 1200° C. The parts were presintered at that temperature with a soaking time of 10 minutes after which the power of the furnace was shut off.

After presintering, the parts were sintered in a Sinter-HIP furnace (PVA COD733R) at 1420° C. with a total soaking time of 60 min. After 30 min at the peak hold temperature, the furnace pressure was raised to 3 MPa Ar.

After sintering, the parts were cut for inspection. The parts from example 7 were absolutely free from cracks, eta-phase and pores, i.e. A00 B00 C00 according to ISO 4505. The parts from Example 8, extracted for 8 hours showed eta-phase and porosity of A06 B04, while those extracted for 3 hours showed carbon pores.

The principles, preferred embodiments, and modes of operation of the present invention have been described in the foregoing specification. The invention, which is intended to be protected herein, however, is not to be construed as limited to the particular forms disclosed, since these are to be regarded as illustrative rather than restrictive. Variations and changes may be made by those skilled in the art without departing from the spirit of the invention.

The invention claimed is:

1. A method of making a sintered body comprising one or more hard constituents in a binder phase by injection molding or extrusion technique comprising mixing by wet milling of powders forming the hard constituents and binder phase with a granulating agent to form a slurry, said granulating agent being an ethylene oxide polymer, wherein mixing forms a slurry;

drying the slurry into a powder;

mixing the dried powder with a binder system into a feedstock binder system being not miscible with said ethylene oxide polymer;

molding said feedstock into a body of desired shape in an injection molding machine or extruder;

debinding of the obtained body in two steps to form a part, the two steps comprising a first step of extraction and a second step of heating, said extraction step being conducted in an alcohol based solvent at a temperature of about 50-78° C., and sintering the part.

2. The method of claim 1, wherein said sintered body is a cemented carbide.

3. The method of claim 2, wherein said cemented carbide is submicron.

4. The method of claim 1, wherein said ethylene oxide polymer is poly(oxy-1,2-ethanediyl)-alpha-hydro-omega-hydroxy-I.

5. The method of claim 1, wherein said alcohol based solvent comprises methyl, ethyl or propyl alcohol.

6. The method of claim 5, wherein said methyl, ethyl or propyl alcohol based solvent is ethyl alcohol.

7. The method of claim 6, wherein the water content of said ethyl alcohol based solvent is less than 30 wt %.

8. The method of claim 1, wherein said sintering is sinterhipping.

9. The method of claim 1, wherein said extraction step is performed at a temperature of 60 to 78° C.

10. The method of claim 9, wherein said extraction step is performed at a temperature of 60 to 70° C.

11. The method of claim 7, wherein the water content of said solvent is less than 10 wt %.

12. The method of claim 11, wherein the water content of said solvent is less than 5 wt %.

13. The method of claim 1, wherein the binder system comprises polyethylene glycol.

14. The method of claim 13, wherein the binder system also comprises a (Polyethylene)-blend-(Poly(oxy-1,2-ethanediyl), .alpha.-hydro-.omega.-hydroxy-)-based wax.

15. The method of claim 1, wherein the second step of heating is conducted in a furnace at a temperature of up to 550° C.

16. The method of claim 15, comprising flowing a hydrogen atmosphere in the furnace.

17. The method of claim 1, comprising pre-sintering the part.

18. The method of claim 1, wherein the binder phase is cobalt and the hard constituents include tungsten carbide.

* * * * *